US009972254B2

(12) United States Patent
Liu et al.

(10) Patent No.: US 9,972,254 B2
(45) Date of Patent: May 15, 2018

(54) COLOR ELECTROPHORETIC DISPLAY APPARATUS AND A DISPLAY DRIVING METHOD THEREOF

(71) Applicant: E Ink Holdings Inc., Hsinchu (TW)

(72) Inventors: Shu-Cheng Liu, Taoyuan (TW); Pei-Lin Tien, Taoyuan (TW); Chi-Mao Hung, Taoyuan (TW)

(73) Assignee: E Ink Holdings Inc., Hsinchu (TW)

( * ) Notice: Subject to any disclaimer, the term of this patent is extended or adjusted under 35 U.S.C. 154(b) by 127 days.

(21) Appl. No.: 15/049,151

(22) Filed: Feb. 22, 2016

(65) Prior Publication Data

US 2017/0084217 A1 Mar. 23, 2017

(30) Foreign Application Priority Data

Sep. 17, 2015 (TW) ..... 104130692 A

(51) Int. Cl.
*G09G 5/10* (2006.01)
*G09G 3/34* (2006.01)

(52) U.S. Cl.
CPC ..... *G09G 3/344* (2013.01); *G09G 2310/068* (2013.01); *G09G 2320/0666* (2013.01)

(58) Field of Classification Search
USPC ..... 345/690
See application file for complete search history.

(56) References Cited

U.S. PATENT DOCUMENTS

2008/0094315 A1* 4/2008 Johnson ..... G09G 3/344 345/58
2010/0238203 A1* 9/2010 Stroemer ..... G09G 3/3611 345/690
2011/0221732 A1* 9/2011 Muto ..... G09G 3/344 345/211
2011/0221740 A1* 9/2011 Yang ..... G09G 3/344 345/214
2012/0001957 A1* 1/2012 Liu ..... G09G 3/344 345/690

FOREIGN PATENT DOCUMENTS

CN 1989541 6/2007

OTHER PUBLICATIONS

"Office Action of Taiwan Counterpart Application," dated May 26, 2016, p. 1-p. 7, in which the listed references were cited.

* cited by examiner

*Primary Examiner* — Srilakshmi K Kumar
*Assistant Examiner* — Chineyere Wills-Burns
(74) *Attorney, Agent, or Firm* — JCIPRNET

(57) ABSTRACT

A color electrophoretic display apparatus and a display driving method thereof are provided. The color electrophoretic display apparatus includes a display panel and a display driver. The display panel includes a plurality of pixels. The display driver is electrically connected to the display panel and configured to drive the display panel to display one of a plurality of colors by using a plurality of driving signals having different waveforms. The driving signals include a first driving signal and a second driving signal. The display driver selects the first driving signal or the second driving signal according to image data, and drives at least one pixel of the display panel by using the first driving signal or the second driving signal, such that the at least one pixel displays one of black color and a plurality of gray colors with different gray values in the plurality of colors.

14 Claims, 5 Drawing Sheets

COLOR ELECTROPHORETIC DISPLAY APPARATUS AND A DISPLAY DRIVING METHOD THEREOF

CROSS-REFERENCE TO RELATED APPLICATION

This application claims the priority benefit of Taiwan application serial no. 104130692, filed on Sep. 17, 2015. The entirety of the above-mentioned patent application is hereby incorporated by reference herein and made a part of this specification.

BACKGROUND OF THE INVENTION

Field of the Invention

The invention relates to a display apparatus and a display driving method thereof, and particularly relates to a color electrophoretic display apparatus and a display driving method thereof.

Description of Related Art

Due to the influence of a manufacturing process and manufacturing materials, after reliability analysis of various temperatures performed on a color electrophoretic display (EPD) apparatus, by using a same low voltage to drive particles of a specific color, it is discovered that different driving results are obtained according to different test conditions. In order to resolve such problem, a driving waveform used for driving the particles of the specific color has to be specifically designed. However, due to an influence of a particle diffusion factor, such driving waveform probably causes a border with other color appeared between a boundary of the specific color and a black color. Spread of such border towards the back color portion is more severe, which results in a difference compared with an original image display.

SUMMARY OF THE INVENTION

The invention is directed to a color electrophoretic display apparatus and a display driving method thereof, which provides a good display quality.

The invention provides a color electrophoretic display apparatus including a display panel and a display driver. The display panel includes a plurality of pixels. The display driver is electrically connected to the display panel and configured to drive the pixels of the display panel to display one of a plurality of colors by using a plurality of driving signals having different signal waveforms. The driving signals include a first driving signal and a second driving signal. The display driver selects the first driving signal or the second driving signal according to image data, and drives at least one pixel of the display panel by using the first driving signal or the second driving signal to display one of a black color and a plurality of gray colors with different gray values in the plurality of colors.

In an embodiment of the invention, the first driving signal includes a first driving period. The second driving signal includes the first driving period and a second driving period. A signal waveform of the second driving signal in the first driving period is the same as a signal waveform of the first driving signal in the first driving period.

In an embodiment of the invention, the second driving signal is configured to driver a target pixel in the pixels. A signal waveform of the second driving signal in the second driving period is determined according to colors to be displayed by a plurality of pixels neighboring to the target pixel and a signal waveform of the first driving signal in a display period.

In an embodiment of the invention, the first driving period includes a display period. A signal waveform of the second driving signal in the second driving period is the same as a signal waveform of the first driving signal in the display period.

In an embodiment of the invention, the driving signals further include a third driving signal and a fourth driving signal. The display driver selects the third driving signal or the fourth driving signal according to the image data, and drives at least one pixel of the display panel by using the third driving signal or the fourth driving signal to display a first color and a second color in the plurality of colors, where the first color is a white color and the second color is one of a red color, a blue color and a green color.

In an embodiment of the invention, the display driver determines to select the first driving signal or the second driving signal to drive the target pixel according to a color to be displayed by a target pixel and colors to be displayed by a plurality of pixels neighboring to the target pixel.

In an embodiment of the invention, when the color to be displayed by the target pixel is selected from one of the black color and the gray colors with different gray values, and the colors to be displayed by the pixels neighboring to the target pixel include one of a red color, a blue color and a green color, the display driver selects the second driving signal to drive the target pixel.

In an embodiment of the invention, when the color to be displayed by the target pixel is selected from one of the black color and the gray colors with different gray values, and the colors to be displayed by the pixels neighboring to the target pixel do not include one of a red color, a blue color and a green color, the display driver selects the first driving signal to drive the target pixel.

The invention provides a display driving method for driving a plurality of pixels in a display panel of a color electrophoretic display apparatus to display an image. The display driving method includes following steps. Image data corresponding to the image is received, so as to output a plurality of driving signals having different signal waveforms according to the image data, where the driving signals include a first driving signal and a second driving signal. The first driving signal or the second driving signal is selected according to image data, and at least one pixel of the display panel is driven by using the first driving signal or the second driving signal to display one of a black color and a plurality of gray colors with different gray values.

In an embodiment of the invention, the first driving signal includes a first driving period. The second driving signal includes the first driving period and a second driving period. A signal waveform of the second driving signal in the first driving period is the same as a signal waveform of the first driving signal in the first driving period.

In an embodiment of the invention, the pixels include a target pixel, and the step of selecting the first driving signal or the second driving signal according to the image data, and driving the at least one pixel of the display panel by using the first driving signal or the second driving signal to display one of the black color and the gray colors with different gray values includes following steps. A signal waveform of the second driving signal in the second driving period is determined according to colors to be displayed by a plurality of pixels neighboring to the target pixel and a signal waveform of the first driving signal in a display period. The second driving signal is selected to drive the target pixel.

In an embodiment of the invention, the first driving period includes a display period. A signal waveform of the second driving signal in the second driving period is the same as a signal waveform of the first driving signal in the display period.

In an embodiment of the invention, the driving signals further include a third driving signal and a fourth driving signal. The display driving method further includes following steps. The third driving signal or the fourth driving signal is selected according to the image data, and at least one pixel of the display panel is driven by using the third driving signal or the fourth driving signal to display a first color and a second color in the plurality of colors, where the first color is a white color and the second color is one of a red color, a blue color and a green color.

In an embodiment of the invention, the pixels include a target pixel, and the step of selecting the first driving signal or the second driving signal according to the image data, and driving the at least one pixel of the display panel by using the first driving signal or the second driving signal to display one of the black color and the gray colors with different gray values includes following steps. It is determined to select the first driving signal or the second driving signal to drive the target pixel according to a color to be displayed by the target pixel and colors to be displayed by a plurality of pixels neighboring to the target pixel.

In an embodiment of the invention, the step of selecting the first driving signal or the second driving signal according to the image data, and driving the at least one pixel of the display panel by using the first driving signal or the second driving signal to display one of the black color and the gray colors with different gray values includes following steps. When the color to be displayed by the target pixel is selected from one of the black color and the gray colors with different gray values, and the colors to be displayed by the pixels neighboring to the target pixel include one of a red color, a blue color and a green color, the second driving signal is selected to drive the target pixel.

In an embodiment of the invention, the step of selecting the first driving signal or the second driving signal according to the image data, and driving the at least one pixel of the display panel by using the first driving signal or the second driving signal to display one of the black color and the gray colors with different gray values includes following steps. When the color to be displayed by the target pixel is selected from one of the black color and the gray colors with different gray values, and the colors to be displayed by the pixels neighboring to the target pixel do not include one of a red color, a blue color and a green color, the first driving signal is selected to drive the target pixel.

According to the above descriptions, in the exemplary embodiments of the invention, the display driver selects different driving signals according to the image data, and drives the pixels of the display panel to display one of the black color and the gray colors with different gray values, so as to provide a good display quality.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

A plurality of embodiments are provided below to describe the invention, though the invention is not limited to the provided embodiments, and the provided embodiments can be suitably combined. A term "couple" used in the full text of the disclosure (including the claims) refers to any direct and indirect connections. For example, if a first device is described to be coupled to a second device, it is interpreted as that the first device is directly coupled to the second device, or the first device is indirectly coupled to the second device through other devices or connection means. Moreover, a terminal "signal" may refer to at least one current, voltage, charge, temperature, data, electromagnetic wave or any other one or a plurality of signals. A term "color" may include a black color, a gray color, a white color or other colors, and the other colors may include but are not limited a red color, a green color or a blue color.

Figure 1:
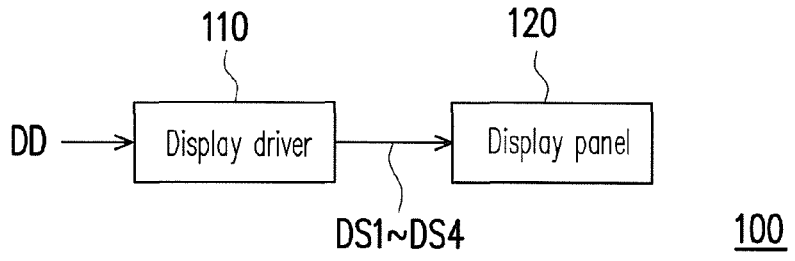
FIG. 1 is a schematic diagram of a color electrophoretic display apparatus according to an embodiment of the invention.
Figure 2:
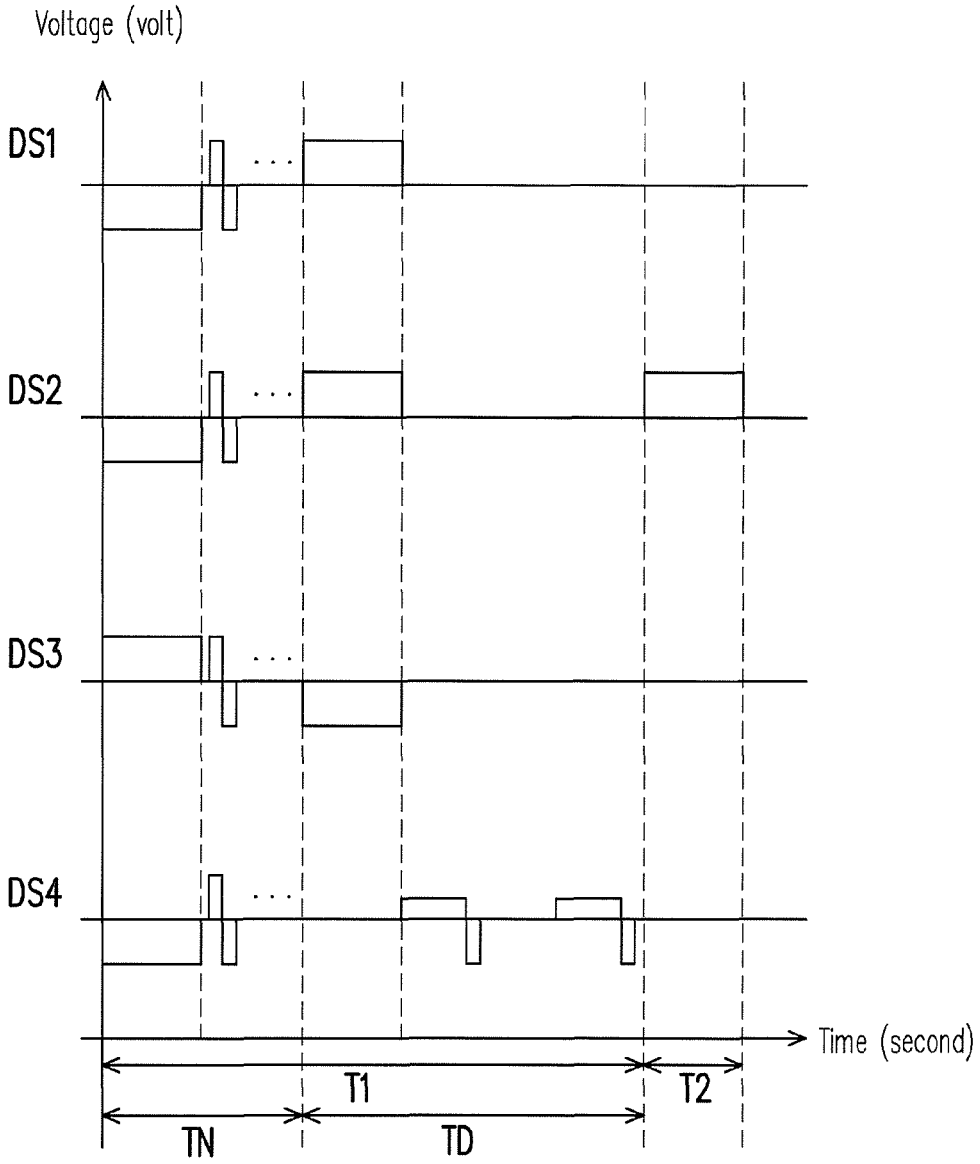
FIG. 2 is a waveform diagram of driving signals having different signal waveforms according to an embodiment of the invention.

FIG. 1 is a schematic diagram of a color electrophoretic display apparatus according to an embodiment of the invention. FIG. 2 is a waveform diagram of driving signals having different signal waveforms according to an embodiment of the invention. Referring to FIG. 1 and FIG. 2, the color electrophoretic display apparatus 100 of the present embodiment includes a display panel 110 and a display driver 120. The display panel 120 includes a plurality of pixels used for displaying an image. The display driver 110 is electrically connected to the display panel 120 and configured to drive the pixels of the display panel 120 by using a plurality of driving signals DS1 to DS4 having different signal waveforms. In the present embodiment, image data DD received by the display driver 110 includes colors to be displayed by the pixels in the image. The display driver 110 selects one of the driving signals DS1 to DS4 according to the received image data DD, and drives the pixels of the display panel 120 to display the corresponding colors. In the present embodiment, the display panel 120 is, for example, a color electrophoretic display panel, and the pixels thereof are configured to display a block color, gray colors, a white color or other colors, and the other colors include but are not limited to a red color, a green color or a blue color.

In the present embodiment, the display driver 110 respectively drives corresponding pixels in the display panel 120 by using the first driving signal DS1 and the second driving signal DS2 having different signal waveforms. The first driving signal DS1 and the second driving signal DS2 respectively include a first driving period T1 and a second driving period T2. The first driving period T1 includes a non-display period TN and a display period TD. In the non-display period TN, the first driving signal DS1 and the second driving signal DS2 are respectively used for driving the display panel 120, and signal waveforms thereof are adapted to perform a direct current (DC) balance operation and a refresh operation to the pixels therein, such that each of the pixels may maintain an initial state and clear a residual previous image. In the present embodiment, the DC balance operation, for example, refers to counteract driving energy to make particles in the solution to maintain the initial state, so as to remove the influence of the time-varying solution viscosity on particle driving. The refresh operation, for example, refers to clear a previous image, so as to remove a blur phenomenon. Moreover, in the present embodiment, the signal waveforms of the first driving signal DS1 and the second driving signal DS2 in the non-display period TN are not limited to that shown in FIG. 2, and different signal waveforms can be designed according to a characteristic of the display panel to implement the DC balance operation and the refresh operation.

In the present embodiment, in the first driving period T1, the first driving signal DS1 and the second driving signal DS2 have the same signal waveform, and are respectively used for driving the pixels to display colors corresponding to the signal waveforms, for example, gray colors or the black color. The gray colors include gray colors with different gray values. In the second driving period T2, the second driving signal DS2 further drives the corresponding pixel through an extra signal waveform, so as to compensate a color distortion of the corresponding pixel generated due to the influence of the neighboring pixels.

In the present embodiment, the signal waveform of the second driving signal DS2 in the second driving period T2 is the same to the signal waveform of the second driving signal DS2 in the display period TD of the first driving period T1, though the invention is not limited thereto. In an embodiment, a width of the signal waveform of the second driving signal DS2 in the second driving period T2 can be greater than or smaller than that of the signal waveform of the second driving signal DS2 in the display period TD of the first driving period T1, and a strength thereof can be greater than or smaller than that of the signal waveform of the second driving signal DS2 in the display period TD of the first driving period T1. The signal waveform of the second driving signal DS2 in the second driving period T1 can be adjusted according to an actual design requirement, which is not limited by the invention.

To be specific, when the display driver 110 drives the pixels in the display panel 120 by using the first driving signal DS1, since colors displayed by a part of the pixels are probably different to the colors to be originally displayed by the part of pixels due to an influence of a particle diffusion driving factor of the neighboring pixels or an influence of other factor that causes incorrect driving of the pixels, the pixels present a color distortion, for example, in a displayed image, a border of other color is appeared in a range of a specific region. Therefore, in the present embodiment, the display driver 110 may drive the pixels occurring the phenomenon of color distortion by using the second driving signal DS2 according to the image data DD of the colors displayed by each of the pixels in the display panel 120, so as to compensate the pixels occurring the phenomenon of color distortion, such that the pixels may correctly display the colors to be displayed. Namely, the display driver 110 selects the first driving signal DS1 or the second driving signal DS2 according to the image data DD to drive the pixels of the display panel 120 to display a gray color or the black color. For example, as shown in FIG. 1 and FIG. 2, the display driver 110 drives a part of the pixels in the display panel 120 to display the black color or the gray color by using the first driving signal DS1. Since these pixels are influenced by the particle diffusion driving factor of the neighboring pixels, the black color or the gray color displayed by the pixels has a color distortion, for example, to present a white color. Therefore, in the present embodiment, the display driver 110 drives the pixels by using the second driving signal DS2, so as to compensate the pixels to correctly display the black color or the gray color.

On the other hand, as shown in FIG. 2, in the present embodiment, the display driver 110 further output the third driving signal DS3 and the fourth driving signal DS4 to drive the pixels on the display panel 120 to display the other colors other than the black color and the gray color, for example, the white color, the red color, the green color or the blue color. For example, in the present embodiment, the signal waveform of the third driving signal DS3 is, for example, a signal waveform used for driving the pixels to display the white color, and the signal waveform of the fourth driving signal DS4 is, for example, a signal waveform used for driving the pixels to display the red color. However, the invention is not limited thereto, and the signal waveform of the fourth driving signal DS4 can also be used for driving the pixels to display the blue color or the green color.

In the present embodiment, the signal waveforms of the third driving signal DS3 and the fourth driving signal DS4 in the non-display period TN are the same as that of the first driving signal DS1 and the second driving signal DS2, and are respectively adapted to perform the DC balance operation and the refresh operation to the pixels. Then, in the display period TD, the third driving signal DS3 and the fourth driving signal DS4 have different signal waveforms, and are respectively used for driving the corresponding pixels to display the white color and other color, for example, the red color. Therefore, in the present embodiment, the display driver 110 selects the third driving signal DS3 or the fourth driving signal DS4 according to the image data DD, and drives the pixels of the display panel 120 to display the white color or the red color.

A driving method that the display driver 110 selects the first driving signal DS1 or the second driving signal DS2 to drive a target pixel to display the black color or the gray color is described below.

Figure 3:
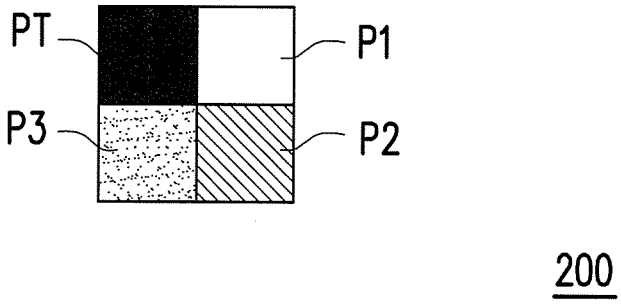
FIG. 3 is a schematic diagram of a pixel array on the display panel according to an embodiment of the invention.

FIG. 3 is a schematic diagram of a pixel array on the display panel according to an embodiment of the invention. Referring to FIG. 1, FIG. 2 and FIG. 3, in the present embodiment, the display driver 110, for example, determines the color to be displayed by a target pixel PT according to the image data DD. If the color to be displayed by the target pixel PT is the white color or the red color, the display driver 110, for example, selects the third driving signal DS3 or the fourth driving signal DS4 to drive the target pixel PT. If the color to be displayed by the target pixel PT is the black color or the gray color, the display driver 110, for example, selects the first driving signal DS1 or the second driving signal DS2 according to the colors to be displayed by the pixels P1 to P3 neighboring to the target pixel PT, and drives the target pixel PT to display the black color or the gray color. In the present embodiment, the pixel array 200 is, for example, a 2×2 pixel array. If the color to be displayed by the target pixel PT is the black color or the gray color, and the color to be displayed by at least one of the pixels P1 to P3 neighboring to the target pixel PT is the red color, due to the influence of the particle diffusion driving factor or the influence of the other factor that causes incorrect driving of the pixels, the pixel displaying the red color probably influences the color to be originally displayed by the target pixel PT, i.e. the black color or the gray color, such that the color displayed by the target pixel PT is distorted and the target pixel PT displays the white color. Therefore, in the present embodiment, the display driver 110, for example, selects the second driving signal DS2 to drive the target pixel PT. Comparatively, if the color to be displayed by the target pixel PT is the black color or the gray color, and the colors to be displayed by the pixels P1 to P3 neighboring to the target pixel PT do not include the red color, in the present embodiment, the display driver 110, for example, selects the first driving signal DS1 to drive the target pixel PT to display the black color or the gray color. Therefore, in the present embodiment, the display driver 110 may determine whether to use the second driving signal DS2 to drive the target pixel PT according to the colors to be displayed by the pixels P1 to P3 neighboring to the target pixel PT, so as to compensate the target pixel PT to correctly display a pixel color.

In the present embodiment, as shown in FIG. 3, the pixels P1, P2 and P3, for example, respectively display the white color, the red color and the gray color, though the invention is not limited thereto. In other embodiments, the colors displayed by the pixels may have various different arrangements, and the display driver 110 may determine whether to use the second driving signal DS2 to drive the target pixel PT according to the different arrangements of the displayed colors. Moreover, in an embodiment, one or a plurality of the pixel P1 to P3 may display the red color, and the number of the neighboring pixels that display the red color is not limited by the invention. Moreover, a position of the target pixel PT is not limited to be an upper left corner of the pixel array 200, and the target pixel driven by the display driver 110 can be located at any position in the pixel array 200, which is not limited by the invention. Moreover, in the present embodiment, a situation that one of the pixels P1, P2 and P3 displays the red color is taken as an example for description, though the invention is not limited thereto. In an embodiment, if one or a plurality of the pixels P1, P2 and P3 displays the blue color or the green color, the display driver 110 may accordingly select the first driving signal DS1 or the second driving signal DS2 to drive the target pixel PT.

Figure 4A:
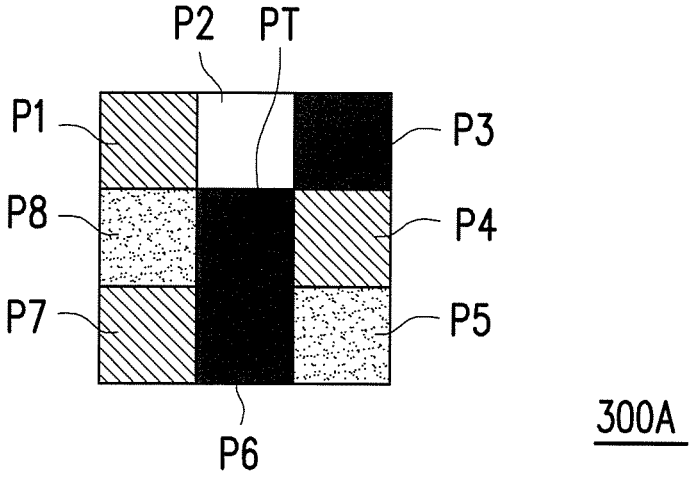
FIG. 4A, FIG. 4B and FIG. 4C are schematic diagrams respectively illustrating pixel arrays on the display panel according to different embodiments of the invention.
Figure 4B:
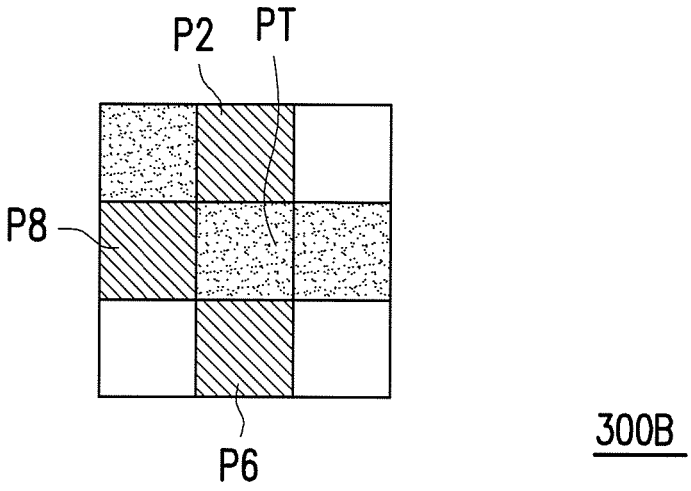
Figure 4C:
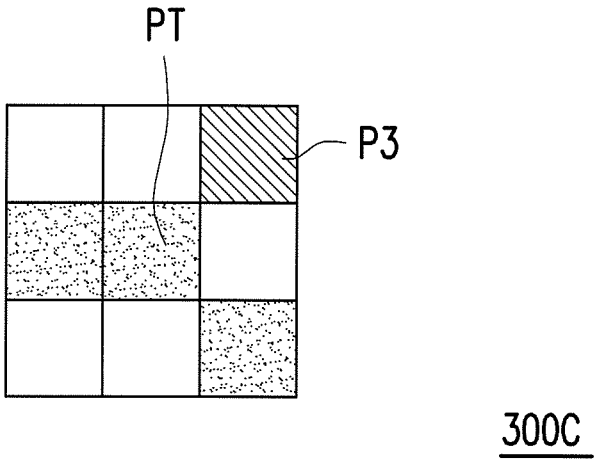

FIG. 4A, FIG. 4B and FIG. 4C are schematic diagrams respectively illustrating pixel arrays on the display panel according to different embodiments of the invention. Referring to FIG. 3 to FIG. 4C, the pixel arrays 300A, 300B and 300C of the embodiments of FIG. 4A to FIG. 4C are similar to the pixel array 200 of the embodiment of FIG. 3, and a main difference there between is that the pixel arrays 300A, 300B and 300C are 3×3 pixel arrays, and arrangements of the colors to be displayed by each pixel of the pixel arrays 300A, 300B and 300C are different.

To be specific, in the embodiment of FIG. 3A, the target pixel PT of the pixel array 300A, for example, displays the black color, and it is determined that in the neighboring pixels P1 to P8, the pixel P4 horizontally neighboring to the target pixel PT and the pixels P1 and P7 diagonally neighboring to the target pixel PT display the red color, the display driver 110, for example, selects the second driving signal DS2 to drive the target pixel PT to display the black color. In other words, the display driver 110, for example, determines to select the first driving signal DS1 or the second driving signal DS2 to drive the target pixel PT according to the color to be displayed by the target pixel PT and the colors to be displayed by the pixels P1 to P8 neighboring to the target pixel PT. For example, in the embodiment of FIG. 4A, since the color to be displayed by the target pixel PT is the black color, and the colors to be displayed by the pixels P1, P4 and P7 neighboring to the target pixel PT include the red color, the display driver 110 selects the second driving signal DS2 to drive the target pixel PT, so as to compensate distortion of the displayed color. Comparatively, if the colors to be displayed by the pixels neighboring to the target pixel PT do not include the red color, the display driver 110 selects the first driving signal to display the target pixel PT.

In the embodiment of FIG. 4B, the target pixel PT of the pixel array 300B, for example, displays the gray color, and it is determined that in the neighboring pixels P1 to P8, the pixels P2 and P6 vertically neighboring to the target pixel PT and the pixel P8 horizontally neighboring to the target pixel PT display the red color, the display driver 110, for example, selects the second driving signal DS2 to drive the target pixel PT to display the gray color. In the embodiment of FIG. 4C, the target pixel PT of the pixel array 300C, for example, displays the gray color, and it is determined that in the neighboring pixels P1 to P8, the pixel P3 diagonally neighboring to the target pixel PT displays the red color, the display driver 110, for example, selects the second driving signal DS2 to drive the target pixel PT to display the gray color.

In other words, in the embodiments of FIG. 4A to FIG. 4C, the neighboring pixels P1 to P8 determined to displaying the red color by the display driver 110 includes the directly neighboring pixels such as the horizontally neighboring pixels, the vertically neighboring pixels and the diagonally neighboring pixels, and the number of the pixels is one to plural. Moreover, in the present embodiment, the second driving signal DS2 is used for driving the target pixel PT to display the black color or the gray color to compensate the display distortion. Therefore, the signal waveform of the second driving signal DS2 in the second driving period T2 is, for example, determined according to the colors to be displayed by the pixels P1 to P8 neighboring to the target pixel PT and the signal waveform of the first driving signal T1 in the display period TD. For example, a width of the signal waveform of the second driving signal DS2 in the second driving period T2 can be adjusted according to the number and positions of the pixels displaying the red color in the neighboring pixels P1 to P8, so as to be greater than, smaller than or equal to a width of the signal waveform of the first driving signal T1 in the display period TD.

Figure 5:
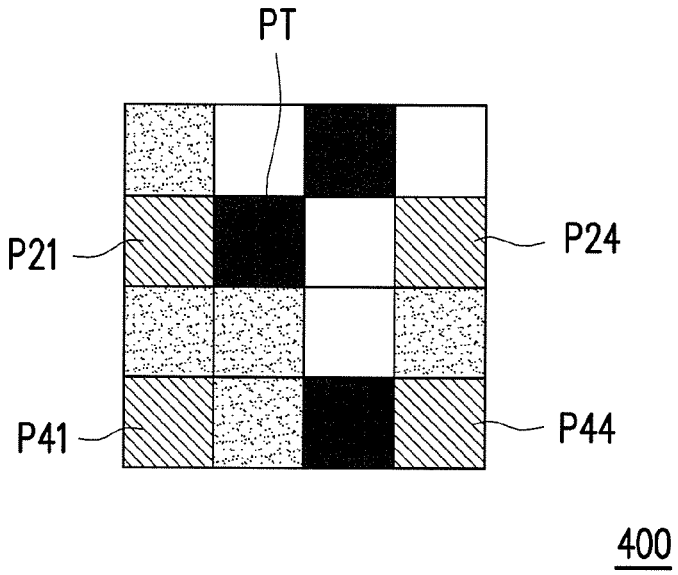
FIG. 5 and FIG. 6 are schematic diagrams respectively illustrating pixel arrays on a display panel according to different embodiments of the invention.
Figure 6:
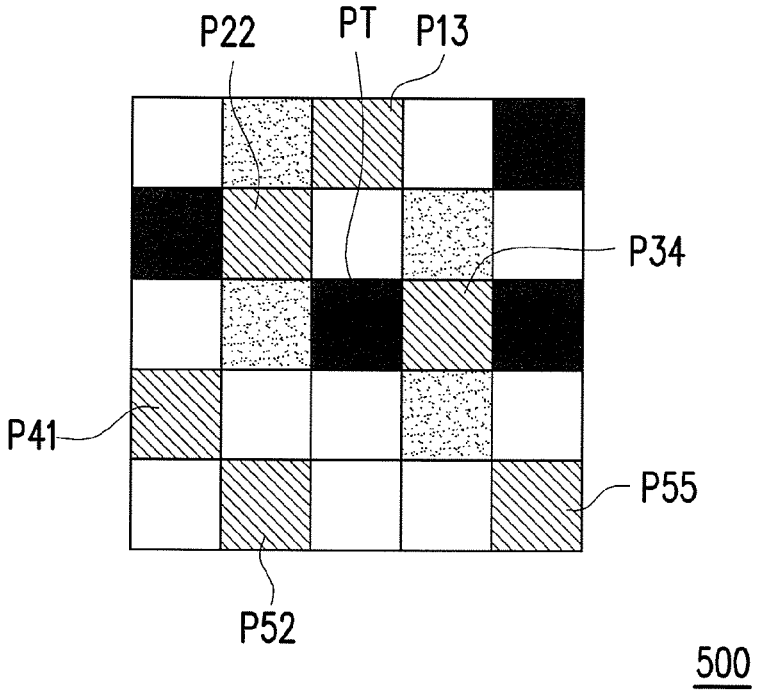

FIG. 5 and FIG. 6 are schematic diagrams respectively illustrating pixel arrays on the display panel according to different embodiments of the invention. Referring to FIG. 3, FIG. 5 and FIG. 6, the pixel arrays 400 and 500 of FIG. 5 and FIG. 6 are similar to the pixel array 200 of the embodiment of FIG. 3, and a main difference there between is that the pixel array 400 is a 4×4 pixel array, and the pixel array 500 is a 5×5 pixel array, and arrangements of the colors to be displayed by each pixel of the pixel arrays 400 and 400 are different.

To be specific, in the embodiment of FIG. 5, the target pixel PT of the pixel array 400, for example, displays the black color, and it is determined that in the neighboring pixels, the pixels P21, P24, P44 and P41 display the red color, the display driver 110, for example, selects the second driving signal DS2 to drive the target pixel PT to display the black color. In the embodiment of FIG. 6, the target pixel PT of the pixel array 500, for example, displays the black color, and it is determined that in the neighboring pixels, the pixels P13, P22, P34, P41, P52 and P55 display the red color, the display driver 110, for example, selects the second driving signal DS2 to drive the target pixel PT to display the black color. In other words, in the embodiments of FIG. 5 and FIG. 6, the neighboring pixels determined to display the red color by the display driver 110 includes the pixels that are not directly neighbored to the target pixel PT such as the pixels P24, P44 and P41 of the pixel array 400.

Figure 7:
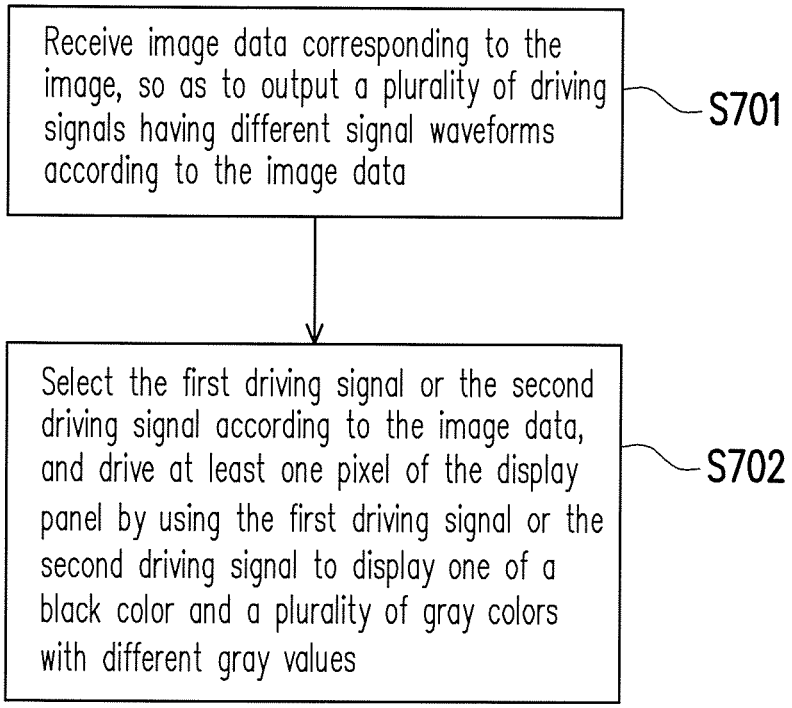
FIG. 7 is a flowchart illustrating a display driving method of a color electrophoretic display apparatus according to an embodiment of the invention.

FIG. 7 is a flowchart illustrating a display driving method of a color electrophoretic display apparatus according to an embodiment of the invention. Referring to FIG. 1 and FIG. 7, the display driving method of the present embodiment is, for example, at least adapted to the color electrophoretic display apparatus 100, and is configured to drive the pixels of the display panel 120 to display an image. In step S701, the display driver 110 receives the image data DD corresponding to the image, so as to output the driving signals DS1 to DS4 having different signal waveforms according to the image data DD. In step S702, the display driver 110 selects the first driving signal DS1 or the second driving signal DS2 according to the image data DD, and derives the pixels of the display panel 230 by using the first driving signal DS1 or the second driving signal DS2 to display the black color or the gray color.

Moreover, enough instructions and recommendations of the display driving method of the color electrophoretic display apparatus can be learned from the descriptions of the embodiments of FIG. 1 to FIG. 6, and detailed description thereof is not repeated In summary, in the exemplary embodiments of the invention, the display driver selects the first driving signal or the second driving signal to drive the target pixel according to the color to be displayed by the target pixel and the colors to be displayed by the pixels neighboring to the target pixels. If the color to be displayed by the target pixel is the gray color or the black color, and the colors to be displayed by the pixels neighboring to the target pixel includes one of the red color, the blue color and the green color, the display driver selects the second driving signal to drive the target pixel, so as to provide a good display quality.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A color electrophoretic display apparatus, comprising:

a display panel, comprising a plurality of pixels; and a display driver, electrically connected to the display panel, and configured to drive the pixels of the display panel to display one of a plurality of colors by using a plurality of driving signals having different signal waveforms, wherein the driving signals comprise a first driving signal and a second driving signal, and the display driver selects the first driving signal or the second driving signal according to image data, and drives at least one pixel of the display panel by using the first driving signal or the second driving signal to display one of a black color and a plurality of gray colors with different gray values in the plurality of colors, wherein the display driver determines to select the first driving signal or the second driving signal to drive a target pixel according to a color to be displayed by the target pixel and colors to be displayed by a plurality of pixels neighboring to the target pixel.

2. The color electrophoretic display apparatus as claimed in claim 1, wherein the first driving signal comprises a first driving period, the second driving signal comprises the first driving period and a second driving period, and a signal waveform of the second driving signal in the first driving period is the same as a signal waveform of the first driving signal in the first driving period.

3. The color electrophoretic display apparatus as claimed in claim 2, wherein a signal waveform of the second driving signal in the second driving period is determined according to colors to be displayed by the plurality of pixels neighboring to the target pixel and a signal waveform of the first driving signal in a display period.

4. The color electrophoretic display apparatus as claimed in claim 2, wherein the first driving period comprises a display period, and a signal waveform of the second driving signal in the second driving period is the same as a signal waveform of the first driving signal in the display period.

5. The color electrophoretic display apparatus as claimed in claim 1, wherein the driving signals further comprise a third driving signal and a fourth driving signal, the display driver selects the third driving signal or the fourth driving signal according to the image data, and drives at least one pixel of the display panel by using the third driving signal or the fourth driving signal to display a first color and a second color in the plurality of colors, wherein the first color is a white color and the second color is one of a red color, a blue color and a green color.

6. The color electrophoretic display apparatus as claimed in claim 1, wherein when the color to be displayed by the target pixel is selected from one of the black color and the gray colors with different gray values, and the colors to be displayed by the pixels neighboring to the target pixel comprise one of a red color, a blue color and a green color, the display driver selects the second driving signal to drive the target pixel.

7. The color electrophoretic display apparatus as claimed in claim 1, wherein when the color to be displayed by the target pixel is selected from one of the black color and the gray colors with different gray values, and the colors to be displayed by the pixels neighboring to the target pixel do not comprise one of a red color, a blue color and a green color, the display driver selects the first driving signal to drive the target pixel.

8. A display driving method, configured to drive a plurality of pixels in a display panel of a color electrophoretic display apparatus to display an image, the display driving method comprising:

receiving image data corresponding to the image, so as to output a plurality of driving signals having different signal waveforms according to the image data, wherein the driving signals comprise a first driving signal and a second driving signal;

selecting the first driving signal or the second driving signal according to the image data, and driving at least one pixel of the display panel by using the first driving signal or the second driving signal to display one of a black color and a plurality of gray colors with different gray values, wherein the pixels comprise a target pixel, and the selecting the first driving signal or the second driving signal according to the image data, and driving the at least one pixel of the display panel by using the first driving signal or the second driving signal to display one of the black color and the gray colors with different gray values comprises:

determining to select the first driving signal or the second driving signal to drive the target pixel according to a color to be displayed by the target pixel and colors to be displayed by a plurality of pixels neighboring to the target pixel.

9. The display driving method as claimed in claim 8, wherein the first driving signal comprises a first driving period, the second driving signal comprises the first driving period and a second driving period, and a signal waveform of the second driving signal in the first driving period is the same as a signal waveform of the first driving signal in the first driving period.

10. The display driving method as claimed in claim 9, wherein the pixels comprise a target pixel, and the selecting the first driving signal or the second driving signal according to the image data, and driving the at least one pixel of the display panel by using the first driving signal or the second driving signal to display one of the black color and the gray colors with different gray values comprises:

determining a signal waveform of the second driving signal in the second driving period according to colors to be displayed by the plurality of pixels neighboring to the target pixel and a signal waveform of the first driving signal in a display period; and selecting the second driving signal to drive the target pixel.

11. The display driving method as claimed in claim 9, wherein the first driving period comprises a display period, and a signal waveform of the second driving signal in the second driving period is the same as a signal waveform of the first driving signal in the display period.

12. The display driving method as claimed in claim 8, wherein the driving signals comprise a third driving signal and a fourth driving signal, and the display driving method further comprises:

selecting the third driving signal or the fourth driving signal according to the image data, and driving at least one pixel of the display panel by using the third driving signal or the fourth driving signal to display a first color and a second color in the plurality of colors, wherein the first color is a white color and the second color is one of a red color, a blue color and a green color.

13. The display driving method as claimed in claim 8, wherein the selecting the first driving signal or the second driving signal according to the image data, and driving the at least one pixel of the display panel by using the first driving signal or the second driving signal to display one of the black color and the gray colors with different gray values comprises:

selecting the second driving signal to drive the target pixel when the color to be displayed by the target pixel is selected from one of the black color and the gray colors with different gray values, and the colors to be displayed by the pixels neighboring to the target pixel comprise one of a red color, a blue color and a green color.

14. The display driving method as claimed in claim 8, wherein the selecting the first driving signal or the second driving signal according to the image data, and driving the at least one pixel of the display panel by using the first driving signal or the second driving signal to display one of the black color and the gray colors with different gray values comprises:

selecting the first driving signal to drive the target pixel when the color to be displayed by the target pixel is selected from one of the black color and the gray colors with different gray values, and the colors to be displayed by the pixels neighboring to the target pixel do not include one of a red color, a blue color and a green color.

* * * * *